US006109372A

United States Patent [19]

Dorel et al.

[11] Patent Number: 6,109,372

[45] Date of Patent: Aug. 29, 2000

[54] ROTARY STEERABLE WELL DRILLING SYSTEM UTILIZING HYDRAULIC SERVO-LOOP

[75] Inventors: Alain P. Dorel, Houston; Shu-Kong Chang, Sugar Land, both of Tex.

[73] Assignee: Schlumberger Technology Corporation, Sugar Land, Tex.

[21] Appl. No.: 09/268,596

[22] Filed: Mar. 15, 1999

[51] Int. Cl.[7] ..... E21B 7/04

[52] U.S. Cl. ..... 175/61; 175/74; 175/269

[58] Field of Search ..... 175/61, 62, 73, 175/269, 74, 317, 324

[56] References Cited

U.S. PATENT DOCUMENTS

| | | |
|---|---|---|
| Re. 33,751 | 11/1991 | Geczy et al. . |
| 2,319,236 | 5/1943 | Isaacks et al. . |
| 2,687,282 | 8/1954 | Sanders . |

(List continued on next page.)

FOREIGN PATENT DOCUMENTS

| | | |
|---|---|---|
| 0 343 800 A2 | 11/1989 | European Pat. Off. . |
| 0 520 733 A1 | 12/1992 | European Pat. Off. . |
| 0 530 045 A1 | 3/1993 | European Pat. Off. . |
| 0 744 526 A1 | 11/1996 | European Pat. Off. . |
| 2 172 324 | 7/1988 | United Kingdom . |
| 2 172 325 | 7/1988 | United Kingdom . |
| 2 177 738 | 8/1988 | United Kingdom . |
| 2 246 151 | 1/1992 | United Kingdom . |
| WO 96/31679 | 10/1996 | WIPO . |

OTHER PUBLICATIONS

Anadrill Schlumberger Brochure, Anadrill Tightens Directional Control with Downhole–Adjustable Stabilizers, no date.

Baker Hughes Inteq. "Rotary Directional Drilling System Enhances Steering with Less Torque and Drag", *Harts Petroleum Engineer International*, Apr. 1997, p. 30.

Barr, J.D., et al., "Steerable Rotary Drilling With an Experimental System", SPE/IADC 29382; Presented at the 1995 SPE/IADC Drilling Conference, Amsterdam, The Netherlands, Feb. 28–Mar. 2, 1995, 16 pages.

Bell, S., "Automated rotary steerable tool passes test", *World Oil*, Dec. 1996, p. 31.

(List continued on next page.)

*Primary Examiner*—Frank Tsay

*Attorney, Agent, or Firm*—Steven L. Christian; Wayne I. Kanak

[57] ABSTRACT

An actively controlled rotary steerable drilling system for directional drilling of wells including a tubular rotary tool collar having rotatably mounted thereabout a substantially non-rotatable sliding sleeve incorporating a plurality of elastic coupling members to maintain the sliding sleeve in coupled relation with the borehole wall during drilling. An offsetting mandrel is supported within the tool collar by a knuckle joint for pivotal movement and is rotatably driven by the tool collar and has a lower end extending from the collar and adapted for support of a drill bit. To achieve controlled steering of the rotating drill bit, orientation of the drilling tool is sensed by navigation sensors and the offsetting mandrel is maintained geostationary and selectively axially inclined relative to the tool collar by orienting it about the knuckle joint responsive to navigation sensors. An alternator and a hydraulic pump, located within the tool collar, are driven by a power source driven by the flowing drilling fluid to produce electric power and hydraulic pressure for supplying electrical power for the electronics package of the tool and for actuation of hydraulic system components. Hydraulic cylinder and piston assemblies, actuated by tool position signal responsive servo-valves, control the angular position of the offsetting mandrel with respect to the tool collar. The hydraulic pistons are servo-controlled responsive to signal input from the navigation sensors and from other tool position sensing systems which provide real-time position signals to the hydraulic position control system.

25 Claims, 4 Drawing Sheets

U.S. PATENT DOCUMENTS 2,694,549 11/1954 James .
2,876,992 3/1959 Lindsay .
3,068,946 12/1962 Frisby et al. .
3,098,534 7/1963 Carr et al. .
3,370,657 2/1968 Antle .
3,457,999 7/1969 Massey .
3,561,549 2/1971 Garrison .
3,575,247 4/1971 Feenstra .
3,637,032 1/1972 Jeter .
3,667,556 6/1972 Henderson .
3,743,034 7/1973 Bradley .
3,799,279 3/1974 Farris .
3,878,903 4/1975 Cherrington .
3,903,974 9/1975 Cullen .
4,040,494 8/1977 Kellner .
4,040,495 8/1977 Kellner et al. .
4,076,084 2/1978 Tighe .
4,080,115 3/1978 Sims et al. .
4,184,553 1/1980 Jones, Jr. et al. .
4,185,704 1/1980 Nixon, Jr. .
4,211,292 7/1980 Evans .
4,220,213 9/1980 Hamilton .
4,291,773 9/1981 Evans .
4,305,474 12/1981 Farris et al. .
4,416,339 11/1983 Baker et al. .
4,428,441 1/1984 Dellinger .
4,449,595 5/1984 Holbert .
4,456,080 6/1984 Holbert .
4,461,359 7/1984 Jones, Jr. et al. .
4,465,147 8/1984 Feenstra et al. .
4,492,276 1/1985 Kamp .
4,523,652 6/1985 Schuh .
4,560,013 12/1985 Beimgraben .
4,635,736 1/1987 Shirley .
4,637,479 1/1987 Leising .
4,638,873 1/1987 Welborn .
4,662,458 5/1987 Ho .
4,667,751 5/1987 Geczy et al. .
4,697,651 10/1987 Dellinger .
4,699,224 10/1987 Burton .
4,714,118 12/1987 Baker et al. .
4,732,223 3/1988 Schoeffler et al. .
4,739,843 4/1988 Burton .
4,807,708 2/1989 Forrest et al. .
4,811,798 3/1989 Falgout, Sr. et al. .
4,821,815 4/1989 Baker et al. .
4,836,301 6/1989 Van Dongen et al. .
4,848,490 7/1989 Anderson .
4,858,705 8/1989 Thiery .
4,867,255 9/1989 Baker et al. .
4,880,067 11/1989 Jelsma .
4,895,214 1/1990 Schoeffler .
4,901,804 2/1990 Thometz et al. .
4,938,298 7/1990 Rehm .
4,947,944 8/1990 Coltman et al. .
4,948,925 8/1990 Winters et al. .
4,951,760 8/1990 Cendre et al. .
4,995,465 2/1991 Beck et al. .
5,050,692 9/1991 Beimgraben .
5,052,501 10/1991 Wenzel et al. .
5,103,919 4/1992 Warren et al. .
5,113,953 5/1992 Noble .
5,117,927 6/1992 Askew .
5,131,479 7/1992 Boulet et al. .
5,139,094 8/1992 Prevedel et al. .
5,163,521 11/1992 Pustanyk et al. .
5,213,168 5/1993 Warren et al. .
5,220,963 6/1993 Patton .
5,265,682 11/1993 Russell et al. .
5,265,687 11/1993 Gray .
5,305,830 4/1994 Wittrisch .
5,305,838 4/1994 Pauc .
5,311,952 5/1994 Eddison et al. .
5,311,953 5/1994 Walker .
5,316,093 5/1994 Morin et al. .
5,325,714 7/1994 Lende et al. .
5,332,048 7/1994 Underwood et al. .
5,343,966 9/1994 Wenzel et al. .
5,375,098 12/1994 Malone et al. .
5,410,303 4/1995 Comeau et al. .
5,421,420 6/1995 Malone et al. .
5,467,834 11/1995 Hughes et al. .
5,484,029 1/1996 Eddison .
5,520,256 5/1996 Eddison .
5,529,133 6/1996 Eddison .
5,594,343 1/1997 Clark et al. .
5,602,541 2/1997 Comeau et al. .
5,617,926 4/1997 Eddison et al. .
5,738,178 4/1998 Williams et al. .

OTHER PUBLICATIONS

Colebrook,, M.A., et al., "Application of Steerable Rotary Drilling Technology to Drill Extended Reach Wells", IADC/SPE 39327, Presented at the 1998 IADC/SPE Drilling Conference, Dallas, Texas, Mar. 3–6, 1998, 11 pages.

Oppelt, J., et al., "Rotary Steerable Drilling System: Status of Development", *Current Issues in Drilling Technology*, GEOPEC, Aberdeen, UK, Sep. 18 and 19, 1996.

Rich, G., et al, "Rotary Closed Loop Drilling System Designed For The Next Millennium", *Hart's Petroleum Engineer International*, May 1997, pp. 47–53.

Warren, T.M., "Trends toward rotary steerable directional systems", *World Oil*, May 1997, pp. 43–47.

ROTARY STEERABLE WELL DRILLING SYSTEM UTILIZING HYDRAULIC SERVO-LOOP

BACKGROUND OF THE INVENTION

1. Field of the Invention

This invention relates generally to methods and apparatus for drilling wells, particularly wells for the production of petroleum products, and more specifically concerns an actively controlled rotary steerable drilling system that can be connected directly to a rotary drill string or can be connected in a rotary drill string in assembly with a mud motor and/or thruster and/or flexible sub to enable drilling of deviated wellbore sections and branch bores. This invention also concerns methods and apparatus enabling precision control of the direction of a wellbore being drilled. This invention also concerns an actively controlled rotary steerable drilling system incorporating a hydraulically energized positioning mechanism for accomplishing automatic geostationary positioning of the axis of an offsetting mandrel and its drill bit during rotation of the offsetting mandrel and drill bit by a rotary drill string, mud motor or both. This invention further concerns employment of coupling means in conjunction with the actively controlled rotary steerable drilling system for maintaining coupling of the drilling tool with the borehole wall during drilling.

2. Description of the Related Art

An oil or gas well often has a subsurface section that is drilled directionally, i.e., inclined at an angle with respect to the vertical and with the inclination having a particular compass heading or azimuth. Although wells having deviated sections may be drilled at any desired location, such as for "horizontal" borehole orientation or deviated branch bores from a primary borehole, for example, a significant number of deviated wells are drilled in the marine environment. In such case, a number of deviated wells are drilled from a single offshore production platform in a manner such that the bottoms of the boreholes are distributed over a large area of a producing horizon over which the platform is typically centrally located and wellheads for each of the wells are located on the platform structure.

In circumstances where the well being drilled is of complex trajectory, the capability provided by the rotary steerable drilling tool of this invention to steer the drill bit while the drill bit is being rotated by the collar of the tool enables drilling personnel to readily navigate the wellbore being drilled from one subsurface oil reservoir to another. The rotary steerable drilling tool of the present invention enables steering of the wellbore both from the standpoint of inclination and from the standpoint of azimuth so that two or more subsurface zones of interest can be controllably intersected by the wellbore being drilled.

A typical procedure for drilling a directional borehole is to remove the drill string and drill bit by which the initial, vertical section of the well was drilled using conventional rotary drilling techniques, and run in a mud motor having a bent housing at the lower end of the drill string which drives the bit in response to circulation of drilling fluid. The bent housing provides a bend angle such that the axis below the bend point, which corresponds to the rotation axis of the bit, has a "toolface angle" with respect to a reference, as viewed from above. The toolface angle, or simply "toolface", establishes the azimuth or compass heading at which the deviated borehole section will be drilled as the mud motor is operated. After the toolface has been established by slowly rotating the drill string and observing the output of various orientation devices, the mud motor and drill bit are lowered, with the drill string non-rotatable to maintain the selected toolface, and the drilling fluid pumps, "mud pumps", are energized to develop fluid flow through the drill string and mud motor, thereby imparting rotary motion to the mud motor output shaft and the drill bit that is fixed thereto. The presence of the bend angle causes the bit to drill on a curve until a desired borehole inclination has been established. To drill a borehole section along the desired inclination and azimuth, the drill string is then rotated so that its rotation is superimposed over that of the mud motor output shaft, which causes the bend section to merely orbit around the axis of the borehole so that the drill bit drills straight ahead at whatever inclination and azimuth have been established. If desired, the same directional drilling techniques can be used as the maximum depth of the wellbore is approached to curve the wellbore to horizontal and then extend it horizontally into or through the production zone. Measurement while drilling "MWD" systems are commonly included in the drill string above the mud motor to monitor the progress of the borehole being drilled so that corrective measures can be instituted if the various borehole parameters indicate variance from the projected plan.

Various problems can arise when sections of the wellbore are being drilled with the drill string non-rotatable and with a mud motor being operated by drilling fluid flow. The reactive torque caused by operation of a mud motor can cause the toolface to gradually change so that the borehole is not being deepened at the desired azimuth. If not corrected, the wellbore may extend to a point that is too close to another wellbore, the wellbore may miss the desired "subsurface target", or the wellbore may simply be of excessive length due to "wandering". These undesirable factors can cause the drilling costs of the wellbore to be excessive and can decrease the drainage efficiency of fluid production from a subsurface formation of interest. Moreover, a non-rotating drill string may cause increased frictional drag so that there is less control over the "weight on bit" and the rate of drill bit penetration can decrease, which can result in substantially increased drilling costs. Of course, a non-rotating drill string is more likely to get stuck in the wellbore than a rotating one, particularly where the drill string extends through a permeable zone that causes significant build up of mud cake on the borehole wall.

A patent of interest in regard to the subject matter of the present invention is U.S. Pat. No. 5,113,953. The '953 patent presents a directional drilling apparatus and method in which the drill bit is coupled to the lower end of a drill string through a universal joint, and the bit shaft is pivotally rotated within the steerable drilling tool collar at a speed which is equal and opposite to the rotational speed of the drill string. The present invention is significantly advanced as compared to the subject matter of the '953 patent in that the angle of the bit shaft or mandrel relative to the drill collar of the present invention is variable rather than fixed. Other patents of interest in regard to the present invention are UK Patents GB 2 172 324 B, GB 2 172 325 B and GB 2 177 738 B. The '738 patent is entitled "Control of drilling courses in the drilling of boreholes" and discloses a control stabilizer 20 having four actuators 44. The actuators are in the form of flexible hoses or tubes which are selectively inflated to apply a lateral force to the drill collar as shown at 22 for the purpose of deflecting the drill collar and thus altering the course of the borehole being drilled. The '324 patent is of interest to the present invention in that it discloses a steerable drilling tool having stabilizers 18 and 20, with a control module 22 located between them for effecting controlled deflection of the drilling tube 10 for altering the course of the wellbore being drilled. The '325 patent is of interest to the present invention in that it discloses a steerable drilling tool having a housing 31 that contains sensing means and is maintained essentially stationary during drilling by a wall contact assembly 33. Movement of the drilling tube 10 relative to the wall contact assembly is accomplished by applying different pressures, in a controlled manner, to each of four actuators 44. Steering of the drill bit, according to the '325 patent, is accomplished by sensing the position of the rotary tool collar and generating navigation signals.

In contrast, the present invention achieves steering of the drill bit by hydraulically maintaining the longitudinal axis of an offsetting mandrel, to which the drill bit is attached, in geostationary position and oriented about a knuckle or pivot mount within a rotatable tool collar which is in direct rotary driving relation with the offsetting mandrel. The offsetting mandrel is kept positioned at the desired inclination and azimuth during its rotation by the hydraulically energized steering system of the rotary steerable drilling tool for steering of the wellbore being drilled along a desired course. A substantially non-rotatable sliding sleeve is employed to provide a housing for navigation sensors and electronics as well as telemetry systems, and for maintaining a coupling relationship with the formation during drilling. The sliding sleeve is supported in rotatable relation about a portion of the rotary tool collar and is maintained in mechanically coupled and substantially non-rotatable relation with the wall of the borehole being drilled by a plurality of elastic blade members which project radially outwardly from the sleeve.

The present invention may also be connected in assembly with a controllable mud motor, a thruster apparatus, a flexible sub or any combination thereof. Additionally, the actively controlled rotary steerable drilling system of the present invention enables directionally controlled drilling to be selectively powered by a rotary drill string, a mud motor, or both, and provides for precision control of weight on bit and accuracy of drill bit orientation during drilling.

Another patent of interest in regard to the present invention is U.S. Pat. No. 5,265,682. The '682 patent discloses a system for maintaining a downhole instrumentation package in a roll stabilized orientation by means of an impeller. The roll stabilized instrumentation is used for modulating fluid pressure to a set of radial pistons which are sequentially activated to urge the bit in a desired direction. The drill bit steering system of the '682 patent most notably differs from the concept of the present invention in the different means that is utilized for deviating the drill bit in the desired direction. Namely, the '682 patent describes a mechanism which uses pistons which react against the borehole wall to force the bit in a desired lateral direction within the borehole. Since the hydraulic components of the steerable drilling system of the '682 patent are exposed to the drilling fluid, and since the rotating pads of the rotating tool are exposed to contact with the borehole wall, the service live of such a drilling tool will be limited.

In contrast, the rotary steerable drilling tool of the present invention has no hydraulic components or force transmitting pad that are exposed to the drilling fluid or the borehole wall. The rotary steerable drilling tool of the present invention incorporates an automatically energized, sensor responsive hydraulic system to maintain the offsetting mandrel of the drilling system in geostationary and angularly oriented relation with the rotatable tool collar to deviate from the main borehole direction and to keep the drill bit pointing in a desired borehole direction. The hydraulic offsetting mandrel positioning system of the present invention accomplishes pivotal positioning of the offsetting mandrel axis about its knuckle or universal joint support within the drill collar so that the offsetting mandrel is kept positioned in geostationary relation with the formation being drilled while it is being rotated by the rotary tool collar. Within the scope of the present invention various navigation sensors and electronics of the tool are located within a substantially non-rotatable sliding sleeve which is mounted for relative rotation about the rotary tool collar of the drilling tool, rather than in a rotating component, such as the tool collar, to enable simplification of the electronics of the navigation sensors to ensure the accuracy and extended service life thereof.

SUMMARY OF THE INVENTION

It is a principal feature of the present invention to provide a novel actively controlled rotary steerable drilling system that is driven by a rotary drill string, a mud motor, or a combination of a rotary drill string and a mud motor, and permits selective drilling of curved wellbore sections by precision steering of the drill bit being rotated by the rotary tool collar of the rotary steerable drilling tool;

It is also a feature of the present invention to provide a novel actively controlled rotary steerable well drilling system having an offsetting mandrel that is rotatably driven by a rotary tool collar during drilling operations and which is pivotally mounted within the tool collar for pivotal articulation within the tool collar and which is kept pointed in geostationary relation with the formation being drilled and is maintained pointed at desired angles of inclination and azimuth for the drilling of a curved wellbore to an intended target;

It is another feature of the present invention to provide a novel actively controlled rotary steerable well drilling system having a drilling fluid powered hydraulic pump that supplies pressurized fluid for position control of an offsetting mandrel by servo-valve controlled energization of hydraulic positioning pistons that accomplish geostationary positioning of the offsetting mandrel relative to the rotary tool collar of the well drilling system for the purpose of drill bit steering;

It is another feature of the present invention to provide a novel actively controlled rotary steerable well drilling system having an on-board electronic power, position sensing and control system that is mounted within a coupling element that is in rotatable relation with the rotary tool collar of the tool and is maintained in coupled and substantially static relation with the wall of the borehole being drilled by a plurality of elastic blades which have coupling engagement with the wellbore wall during drilling. It is also a feature of the present invention to locate navigation sensors and certain electronics within the substantially static coupling element rather than in rotary components of the drilling tool, thus protecting the on-board electronics and navigation sensors of the tool against possible rotation induced interference and permitting significant simplification of the control circuitry of the tool; and It is also a feature of the present invention to provide a novel actively controlled rotary steerable well drilling system having a substantially non-rotatable sliding sleeve disposed in rotatable relation with the rotary tool collar and having elongate curved elastic coupling blades that maintain sliding coupling of the drilling tool with respect to the formation being drilled, restrain rotation of the substantially non-rotatable sliding sleeve, and provide for caliper measurements of the borehole being drilled.

Briefly, the various objects and features of the present invention are realized through the provision of an actively controlled rotary steerable drilling tool having a rotary tool collar that is rotatably driven by a rotary drive component, such as the output shaft of a mud motor or a rotary drill string, that is driven by the rotary table of a drilling rig. An offsetting mandrel, also sometimes referred to herein as a bit shaft, is mounted within the rotatable tool collar by means of a universal mount or knuckle joint and is rotatable directly by the rotary tool collar for the purpose of drilling. A lower section of the offsetting mandrel projects from the lower end of the rotary tool collar and provides a connection to which the drill bit is threadedly connected. According to the concept of this invention, the offsetting mandrel axis is maintained and pointed in a given direction which is inclined by a variable angle with respect to the axis of the rotary drive component of the tool during rotation of the offsetting mandrel by the rotary drive component, thus allowing the drill bit to drill a curved wellbore on a curve that is determined by the selected angle. A straight bore can be drilled by setting the angle between the offsetting mandrel axis and the tool axis to zero.

The angle between the axis of the rotary tool collar and the axis of the offsetting mandrel is maintained by a plurality of hydraulic pistons which are located within the rotary tool collar and are selectively controlled and positioned by sensor responsive servo-loop activated servo-valves to maintain the axis of the offsetting mandrel geostationary and at predetermined angles of inclination and azimuth. Additionally, these predetermined angles of inclination and azimuth are selectively controllable responsive to surface generated control signals, computer generated signals, sensor generated signals or a combination thereof. Thus the rotary steerable drilling tool of this invention is adjustable while the tool is located downhole and during drilling for controllably changing the angle of the offsetting mandrel relative to the rotatable collar as desired for the purpose of controllably steering the drill bit being rotated by the offsetting mandrel of the tool.

Torque is transmitted from the rotary tool collar to the offsetting mandrel directly through an articulatable driving connection that is established by the knuckle joint connection of the offsetting mandrel within the tool collar. In addition, the hydraulic mandrel positioning pistons are servo-controlled to guarantee that the predetermined toolface is maintained in the presence of external disturbances. Since it should always remain geostationary, the offsetting mandrel is maintained in its geostationary position within the rotary tool collar by hydraulically energized pistons that are mounted for movement within the tool collar. This feature is accomplished by automatic servo-controlled hydraulic actuation of the positioning pistons which are precisely controlled responsive to signals from various navigation sensors and responsive to various forces that tend to alter the orientation of the axes of the sliding tool collar and the offsetting mandrel.

To enhance the flexibility of the actively controlled rotary steerable drilling tool, the tool has the capability of selectively incorporating many electronic sensing, measuring, feedback and positioning systems. A three-dimensional positioning system of the tool can employ magnetic sensors for sensing the earth's magnetic field and can employ a resolver, three-axis accelerometers and gyroscopic sensors for accurately determining the position of the tool at any point in time. For control, the rotary steerable drilling tool will typically be provided with a three-axis accelerometer and a resolver. A single gyroscopic sensor can also be incorporated within the tool to provide rotational speed feedback and to assist in stabilization of the mandrel, although a plurality of gyroscopic sensors may be employed as well without departing from the spirit and scope of this invention. The signal processing system of the electronics on-board the tool achieves real-time position measurement while the offsetting mandrel of the tool is rotating. The sensors and electronics processing system of the tool also provide for continuous measurement of the azimuth and the actual angle of inclination as drilling progresses so that immediate corrective measures can be taken in real time, without necessitating interruption of the drilling process. The tool incorporates a position based control loop using magnetic sensors, accelerometers or gyroscopic sensors to provide position signals for controlling axial orientation of the offsetting mandrel. Also from the standpoint of operational flexibility, the tool may incorporate a measurement while drilling (MWD) system for feedback, gamma ray detectors, resistivity logging, density and porosity logging, sonic logging, and a system for borehole imaging, look ahead and look around instrumentation, inclination at the bit measurement, bit rotational speed measurement, and measurement of vibration below the motor sensors, weight on bit, torque on bit, and bit side force.

Additionally, the electronics and control instrumentation of the rotary steerable drilling tool provides the possibility for programming the tool from the surface so as to establish or change the tool azimuth and inclination and to establish or change the bend angle relation of the offsetting mandrel to the tool collar. The electronic memory of the on-board electronics of the tool is capable of retaining, utilizing, and transmitting a complete wellbore profile and accomplishing geosteering downhole so the tool can be employed from kick-off to extended reach drilling. Additionally, a flexible sub may be employed with the tool to decouple the rotary steerable drilling tool from the rest of the bottom hole assembly and drill string and allow navigation by the electronics of the rotary steerable drilling system.

In addition to other sensing and measuring features of this invention, the actively controlled rotary steerable drilling tool may also be provided with a telemetry system to transmit bidirectionally through the flexible sub and other measurement subs to the MWD system logging and drilling information that is obtained during drilling operations. The tool may incorporate transmitters and receivers located in predetermined axially spaced relation to thus cause signals to traverse a predetermined distance through the subsurface formation adjacent the wellbore and thus measure its resistivity while drilling activity is in progress.

The electronics of the resistivity system of the tool, as well as the electronics of the various measurement and control systems, are mounted within a substantially non-rotatable sliding sleeve which is disposed in rotatable relation with the rotary collar of the tool. The substantially non-rotatable sliding sleeve is coupled with the formation during drilling by a plurality of elastic coupling blades which also serve to restrain rotation of the sliding sleeve. This feature causes the sleeve to slide along the borehole wall so that the sleeve is essentially static or may rotate only a few turns per hour rather than being rotated along with the rotary components of the tool. Thus, the navigation sensors and the electronics system of the tool are protected from potential rotational induced interference or damage as drilling operations occur.

In the preferred embodiment of the present invention a hydraulic pump is provided within the rotary tool collar of the rotary steerable drilling tool to develop hydraulic pressure in the on-board hydraulic system of the tool to provide for operation of hydraulically energized pistons for controllable positioning of the offsetting mandrel relative to the rotary tool collar. The hydraulic pump is driven by the flowing drilling fluid. The pressurized hydraulic fluid is controllably applied to piston chambers responsive to sensor signal induced actuation of servo-valves to maintain the axis of the offsetting mandrel geostationary and at desired angles of inclination and azimuth during drilling. Hydraulic pressure generated by the hydraulic pump may also be employed in an on-board system including linear variable differential transformers (LVDT's) to sense displacement of the mandrel actuation pistons and to provide displacement signals that are processed and utilized for controlling hydraulic actuation of the pistons. LVDT's are also employed to measure radial displacement of the elastic coupling members for identifying the precise position of the actively controlled rotary steerable drilling tool with respect to the centerline of the wellbore being drilled.

For the purpose of mechanical efficiency, according to the preferred embodiment, the offsetting mandrel positioning system employs a universal offsetting mandrel support in the form of any suitable universal joint or knuckle joint to provide the offsetting mandrel with efficient support in both axial direction and torque and at the same time to minimize friction at the universal joint. Friction at the universal joint is also minimized by ensuring the presence of lubricating oil about the components thereof and by excluding drilling fluid from the universal joint while permitting significant steering control movement of the offsetting mandrel relative to the rotary tool collar as drilling is in progress. The universal joint may conveniently take the form of a spline type joint, a universal joint incorporating splines and rings, or a universal joint incorporating a plurality of balls which permit relative angular positioning of the axis of the offsetting mandrel with respect to the axis of the rotary drive component that extends into and is concentric with the tool collar.

Electrical power for control and operation of the solenoid valves and the electronics system of the drilling tool is generated by an on-board alternator which is also powered by the flowing drilling fluid via a turbine or positive displacement motor which is exposed to the flowing drilling fluid. The electrical output of the alternator may also be utilized for maintaining the electrical charge of a battery pack that provides electrical power for operation of the on-board electronics and for operation of various other on-board electronic equipment during times when the alternator is not being powered by flowing fluid.

BRIEF DESCRIPTION OF THE DRAWINGS

So that the manner in which the above recited features, advantages and objects of the present invention are attained can be understood in detail, a more particular description of the invention, briefly summarized above, may be had by reference to the preferred embodiment thereof which is illustrated in the appended drawings, which drawings are incorporated as a part hereof.

It is to be noted, however, that the appended drawings illustrate only a typical embodiment of the invention and are therefore not to be considered limiting of its scope, for the invention may admit to other equally effective embodiments.

In the Drawings:

FIG. 1 is a schematic illustration showing a well being drilled in accordance with the present invention and showing deviation of the lower portion of the wellbore by the actively controlled rotary steerable drilling system and method thereof;

FIG. 2 is a sectional view showing a rotary steerable drilling system constructed in accordance with the principles of the present invention;

Figure 3:
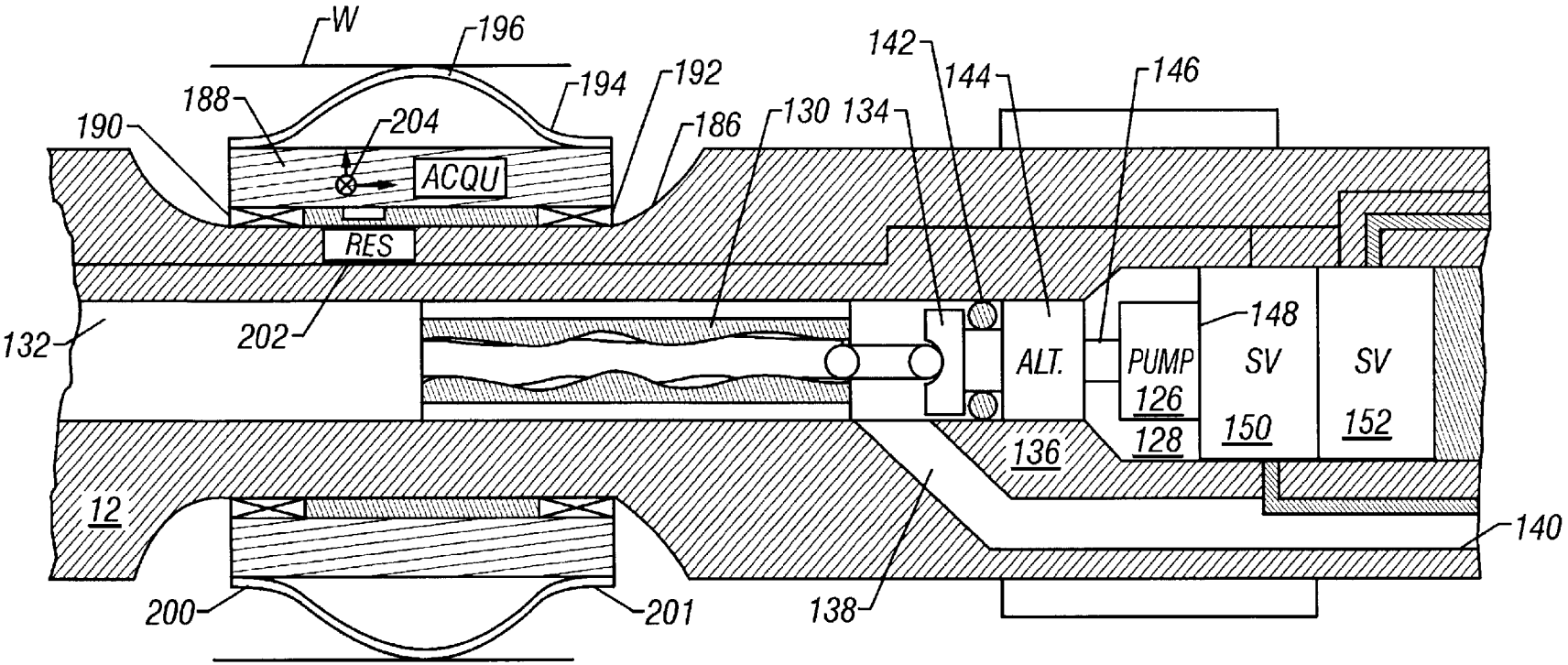
Figure 4:
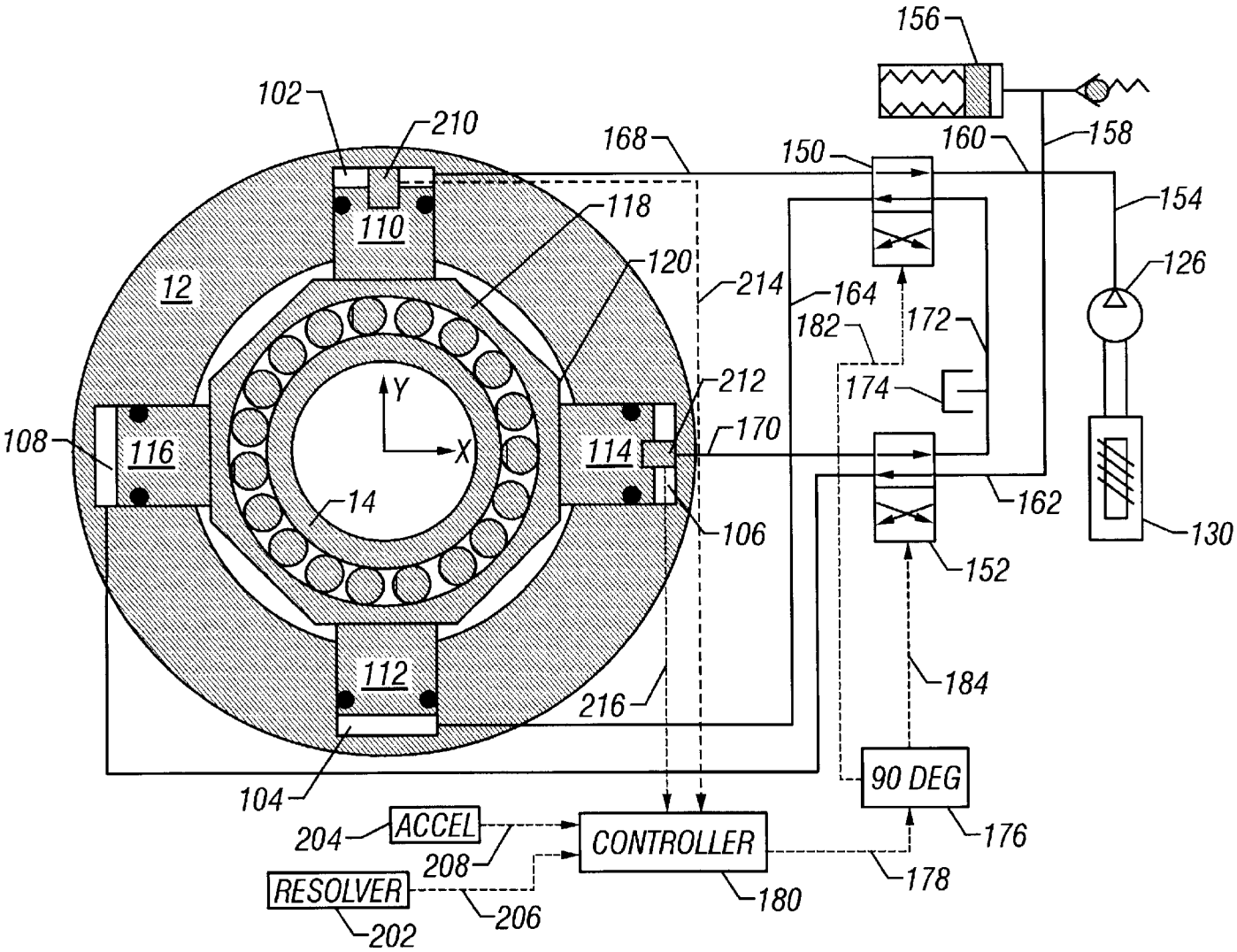

FIG. 3 is a sectional view showing a part of the actively controlled rotary steerable drilling system of the present invention and showing the drilling fluid energized system for generation of electrical energy and hydraulic pressure and further showing a substantially non-rotatable sliding sleeve disposed in rotatable relation with the rotary tool collar and maintained in substantially static relation with the formation being drilled by a plurality of elastic coupling blades; and FIG. 4 is a hydraulic and electronic schematic illustration showing a hydraulic servo-loop that provides for sensor signal responsive control of the hydraulic piston actuation system of the rotary steerable drilling tool.

DESCRIPTION OF THE PREFERRED EMBODIMENT

The actively controlled rotary steerable drilling system of the present invention consists of four basic sections, an offsetting mechanism, a sliding sleeve, a control system and a power generation system.

Offsetting Mechanism—The offsetting mechanism integrates the bit shaft or offsetting mandrel and the rotary tool collar. The offsetting mandrel is coupled to the tool collar through a universal joint which enables the rotary tool collar to impart driving rotation to the offsetting mandrel and the drill bit that is connected at the forward end of the offsetting mandrel. The universal joint permits maintenance of selected angular positioning of the offsetting mandrel relative to the tool collar as the tool collar imparts rotation to the offsetting mandrel. This feature permits torque and weight forces to be transmitted from the tool collar to the offsetting mandrel while keeping the offsetting mandrel pointed in a given direction for drilling a deviated, i.e., curved wellbore. The direction of the offsetting mandrel is kept fixed in space by the action of four hydraulic pistons actuated by two servo-valves.

Sliding Sleeve—A sliding sleeve is mounted for relative rotation about a section of the rotary tool collar and is coupled to the wall of the borehole by a plurality of, typically three, elastic blades that project outwardly from the sliding sleeve and maintain the sliding sleeve in substantially non-rotatable relation with the borehole wall. The sliding sleeve provides support for navigation sensors including a three-axis servo-accelerometer and a resolver and provides support for position signal acquisition electronics. The sliding sleeve also supports a rotating transformer to transmit accelerometer measurements to the rotating section of the drilling tool. A caliper measurement of the borehole being drilled can also be integrated within the rotary steerable drilling system by measuring the axial displacement of each of the three elastic coupling blades relative to the sliding sleeve.

Control System—The steering control system of the rotary steerable drilling tool of the present invention is in the form of a hydraulic servo-loop, also referred to as a control loop, which is integrated with the navigation sensors and electronics of the tool. The hydraulic servo-loop includes a resolver to detect the orientation of the drill collar relative to the sliding sleeve and also includes a three-axis accelerometer to detect the orientation of the sliding sleeve relative to the gravity field. The hydraulic servo-loop also includes two LVDT's to detect the radial positions of the hydraulic pistons relative to the hydraulic cylinders of the rotary tool collar within which the pistons are movably retained. Two electrically controlled servo-valves are also incorporated within the hydraulic servo-loop to synchronize the hydraulic pistons relative to the rotary tool collar. The hydraulic servo-loop also includes signal acquisition and control electronics for the navigation sensors and servo-valves.

Power Generation—Power from the flowing drilling fluid is converted to mechanical power by using a positive displacement motor (PDM) or turbine. The output shaft of the PDM or turbine is coupled to a pump (gear or piston pump) which provides hydraulic power to the servo-valves. An alternator is also coupled to the PDM or turbine output shaft to provide electrical power for operation of the electronics and sensors of the rotary steerable drilling system.

The actively controlled rotary steerable drilling system of the present invention is also capable of being linked with a system for measurement while drilling (MWD) or logging while drilling (LWD). Two-way communication with a MWD/LWD tool may be achieved by using induction type transmission through the formation being drilled. The two-way communication system of the rotary steerable drilling system of the present invention also allows integration of a mud motor between the MWD/LWD tool and the rotary steerable drilling system, so that the mud motor can be used to provide rotary power for rotation of the tool collar and to provide the drilling tool with adequate torque and weight for efficient steerable drilling. The hydraulic power needed to synchronize the four hydraulic pistons and to achieve and maintain bit offset is delivered by the PDM or turbine through the hydraulic pump and the two servo-valves.

The orientation of the offsetting mandrel relative to the gravity field is obtained from two sets of measurements. The rotation of the rotary tool collar relative to the gravity field (tool face) is determined with the combined measurements of the rotation of the tool collar relative to the sliding sleeve (resolver) and the rotation of the sliding sleeve relative to the gravity field (accelerometers). As rotation of the sliding sleeve relative to the borehole is very slow (a few turns per hour), the signal from the radial accelerometers can be easily filtered to reject noise induced by shocks and vibrations in order to keep only the DC component of the signal. The position of the offsetting mandrel relative to the rotary tool collar is determined from the combined measurements of the displacement of the two sets of hydraulic pistons. This displacement is measured with two LVDT's located inside the piston chamber.

Figure 2:
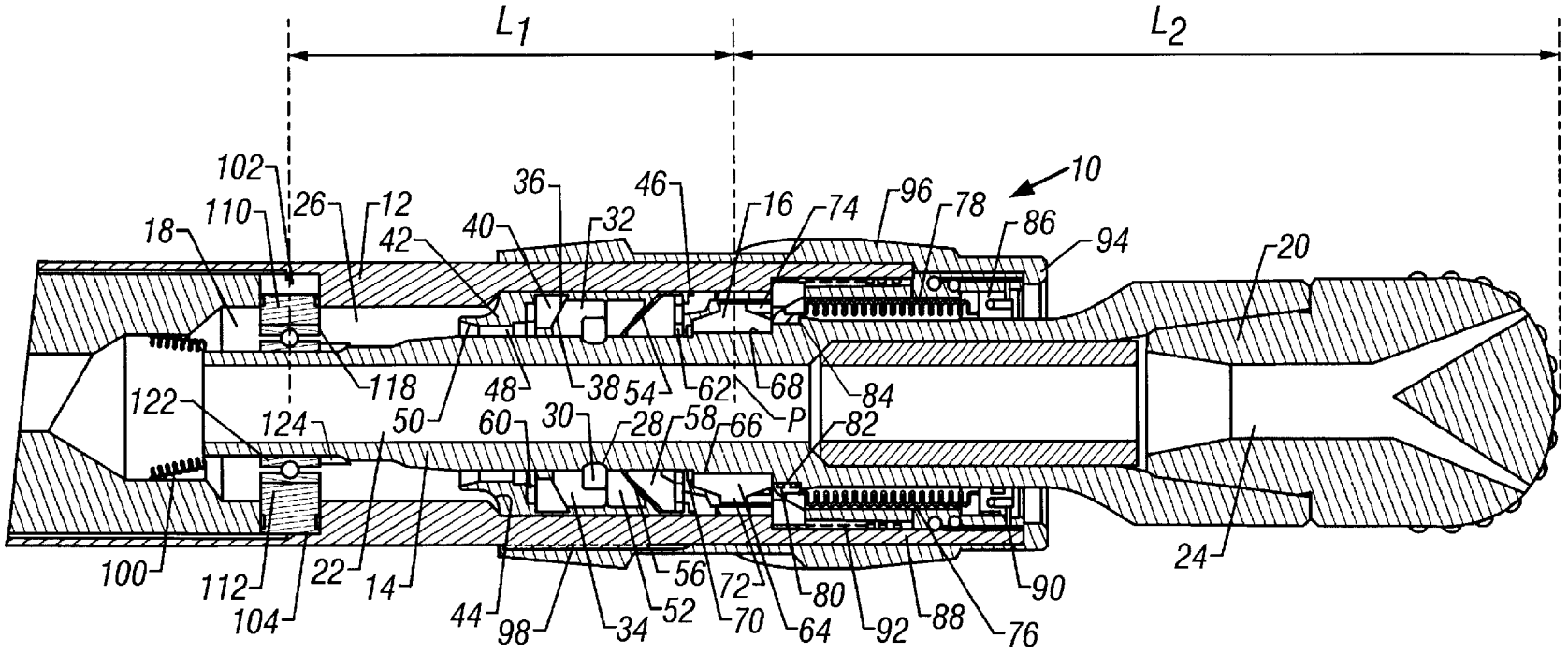

From the standpoint of kinematics, the amplitude of the displacement of pistons along the X and Y axes relative to the rotary tool collar is sinusoidal and the difference in phase between X and Y displacements is 90°:

$Ax=A \sin(wt)$ $Ay=A \sin(wt+90°)$ with A=Bit offset (L1/L2 as shown in FIG. 2) and w=rotation speed of the rotary tool collar.

The combination of Ax and Ay displacement with the rotation of the rotary tool collar results in a stationary vector which keeps the axis of the offsetting mandrel pointed in a fixed direction. The tool face is determined by the orientation of this stationary vector relative to the gravity field.

Figure 1:
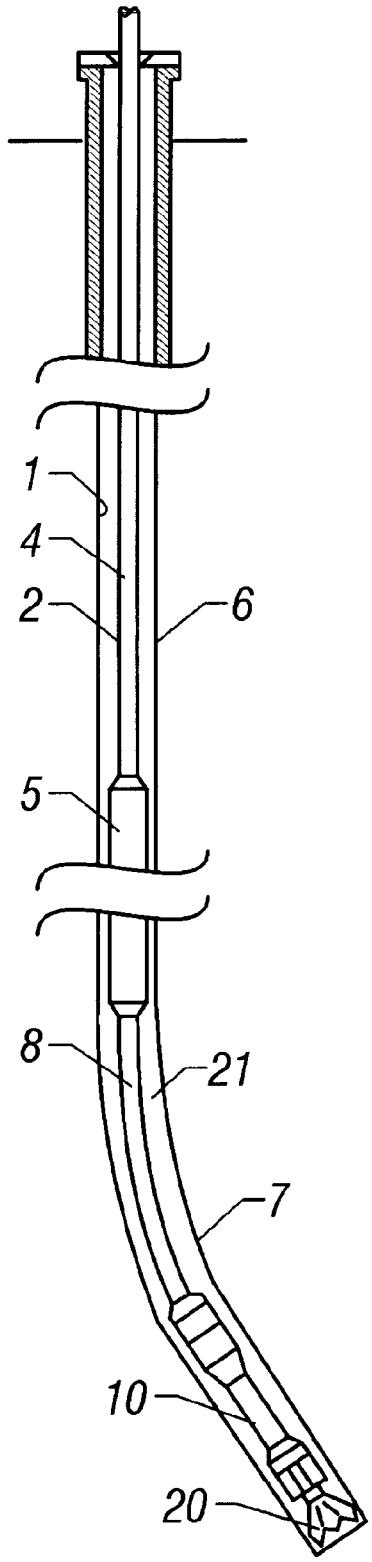

Referring now to the drawings and first to FIG. 1, a wellbore 1 is shown being drilled by a rotary steerable drilling tool embodying the principles of the present invention and shown generally at 10. The rotary steerable drilling tool 10 is connected at the lower end of a drill string shown generally at 2 that extends upwardly to the surface where it is driven by the rotary table of a typical drilling rig (not shown). It should be borne in mind that a rotary drill string is not necessary for practice of the present invention. The rotary drilling tool may also be driven by the rotary output shaft of a mud motor which is connected to a non-rotatable drill string. Alternatively, a rotary drill string may be employed and a mud motor may be connected within it so that the rotary drill string may be operated at a desired rotary speed and the drill bit driven by the mud motor may be operated at a different rotary speed. The drill string 2 typically incorporates a drill pipe 4 having one or more drill collars 5 connected therein for the purpose of applying weight to the drill bit and for stabilizing the drill string. The wellbore 1 is shown as having a vertical or substantially vertical upper portion and a deviated, curved or horizontal lower section 7 which is being drilled under the control of the actively controlled rotary steerable drilling tool 10. The lower section 7 of the wellbore will have been deviated from the vertical upper section by the steering activity of the drilling tool 10 in accordance with the principles set forth herein. As shown in FIG. 1, the drill string, immediately adjacent the rotary steerable drilling tool 10, may incorporate a flexible sub 8, which can provide the rotary steerable drilling system with enhanced accuracy of drilling. In accordance with the usual practice, drilling fluid or "mud" is circulated by surface pumps (not shown) down through the drill string 2 where it exits through jets that are defined in the drill bit 20 and returns to the surface through an annulus 21 between the drill string 2 and the wall of the wellbore 1. As will be described in detail below, the rotary steerable drilling tool 10 is constructed and arranged to cause the drill bit 20 to drill along a curved path that is designated by the control settings of the drilling tool. Referring to FIG. 2, the angle of the offsetting mandrel 14 supporting the drill bit 20 in controlled angular relation with respect to the rotatable tubular tool collar 12 of the drilling tool 10 is maintained even though the drilling tool and drill bit are being rotated by the drill string, mud motor or other rotary drive mechanism, thereby causing the drill bit to be steered for drilling a curved wellbore section. Steering of the drilling tool is selectively accomplished from the standpoint of inclination and from the standpoint of azimuth, i.e., left and right. Additionally, the offsetting mandrel position settings of the rotary steerable drilling tool may be changed as desired, such as by mud pulse telemetry, to cause the drill bit to selectively alter the course of the wellbore being drilled to thereby direct the deviated wellbore with respect to X, Y and Z axes for precision steering of the drill bit and thus precision control of the wellbore being drilled.

Referring again to FIG. 2, the actively controlled rotary steerable drilling tool 10 incorporates a rotary tool collar 12 that is rotatable by any suitable means such as the rotary output of a mud motor or a rotatable drill string. Within the rotary tool collar 12, the offsetting mandrel 14 is supported by a universal joint shown generally at 16 which enables the offsetting mandrel 14 to be rotated along with the tool collar 12 during drilling and permits the offsetting mandrel to be pivoted about a pivot point P relative to the tool collar to thereby enable controllable geostationary orientation of the offsetting mandrel as it is rotated by the rotary tool collar 12 to thus permit the borehole being drilled to be controllably deviated from the axis of the main wellbore. During drilling operations, geostationary positioning of the offsetting mandrel 14 relative to the rotary tool collar 12 is controllably established by an offsetting mechanism shown generally at 18. To achieve geostationary positioning of the offsetting mandrel 14 during its rotation by the rotary tool collar 12, the offsetting mandrel is continuously positioned relative to the velocity of rotation by the offsetting mechanism 18, so that as the offsetting mandrel is rotated, it is kept pointed in a predetermined direction of azimuth and inclination. This feature enables the wellbore being drilled to be steered in a predetermined manner such as might be needed for drilling branch bores from main wellbores or steering a wellbore being drilled to intersection with a subsurface anomaly of interest.

During drilling, the offsetting mandrel 14 is rotatably driven by the rotating tool collar 12 in a manner such that the rotary force of the tool collar is imparted directly to the offsetting mandrel so that the offsetting mandrel and its drill bit are driven directly as the tool collar 12 is rotated. Additionally, the universal joint 16 connecting the offsetting mandrel 14 with the rotary tool collar permits upwardly directed thrust force of the drill bit 20 reacting with the formation being drilled to be transferred from the offsetting mandrel 14 through the universal joint 16 to the tool collar 12. Accordingly, the offsetting mandrel 14 is shown to be of tubular form, thus defining a flow passage 22 through which drilling fluid is permitted to flow as it progresses to the flow passage system 24 of the drill bit 20. Between the tool collar 12 and the offsetting mandrel 14 the rotary steerable drilling tool 10 defines an annular space 26 which contains a protective fluid medium such as lubricating oil, and thus is referred to herein as an oil chamber. The various components of the offsetting mechanism and the universal joint are therefore protected by the protective fluid medium for the purpose of isolating these components from the corrosive and erosive drilling fluid and thus enhancing the service life of the rotary steerable drilling mechanism. The oil or other protective fluid medium within the chamber 26 is sealed with respect to the downhole drilling fluid environment by bellows seal assemblies to be discussed in detail below. Thus the oil within the oil chamber 26 is not only a lubricating medium but also functions in concert with the bellows seals to isolate the offsetting mechanism of the rotary steerable drilling tool from contamination by the drilling fluid.

To permit the transfer of thrust forces from the offsetting mandrel to the tool collar 12, the offsetting mandrel 14 defines an external circular groove 28 which receives at least two thrust force transfer segments 30. The thrust force transfer segments 30 are retained within the circular groove 28 by the circular retainer flange 32 of a thrust force transfer element 34. The thrust force transfer element 34 defines a curved axial end surface 36 which is positioned in force transmitting contact with a concave tapered surface 38 of a thrust force transmitting ring 40. The thrust force transmitting ring 40 is shouldered within a thrust force transfer sleeve 42 which is in turn shouldered against an internal shoulder 44 of the tool collar 12. The thrust force transfer sleeve 42 is secured against axial movement relative to the tool collar 12 by a retainer element 46. The thrust force transfer sleeve 42 also defines an internal opening 48 which is of sufficient dimension to permit the range of pivotal movement that the offsetting mandrel 14 is allowed relative to the tool collar 12. The internal opening 48 is defined in part by a flared or tapered surface 50 which ensures that the thrust force transfer sleeve 42 will not interfere with positioning of the offsetting mandrel 14 within the rotary tool collar 12.

A retainer ring 52 is located in contact with the circular retainer flange 32 of the thrust force transfer element 34 and assists the retainer flange 32 in capturing the thrust force transfer segments 30 within the circular groove 28 of the offsetting mandrel 14. The retainer ring 52 defines a spherical concave surface segment 54 which is in force transmitting contact with a convex spherical surface segment 56 of a pivot control ring 58. The ring-like elements 40, 34, 52 and 58 are maintained in force transmitting engagement with one another and with the force transmitting segments 30 by the action of Belleville springs 60 and 62. The Belleville springs 60, 62 also yield sufficiently to permit pivotal movement of the offsetting mandrel 14 about the pivot point P and to allow thrust force transfer element 34 and retainer ring 52 to move laterally along with the offsetting mandrel while the corresponding thrust force transmitting ring 40 and pivot control ring 58 remain essentially static within the thrust force transfer sleeve 42. Thus, as the drilling operation is in progress, upward thrust forces are transferred from the offsetting mandrel 14 to the rotary tool collar 12 via the thrust force transfer segments 30, the thrust force transfer element 34 and the thrust force transmitting ring 40, as well as the upper end section of the thrust force transfer sleeve 42. Downward forces which will also be transmitted between the tool collar 12 and the offsetting mandrel 14 will be transferred via the thrust force transfer segments 30, the retainer ring 52 and the pivot control ring 58. These downward thrust forces will also be accommodated by the universal joint shown generally at 16 and by the lower Belleville spring 62.

To provide for rotation of the offsetting mandrel 14 by the tool collar 12, a universally driven element 64 is located with its inner circular periphery 66 disposed in non-rotatable relation with a driven section 68 of the offsetting mandrel 14. The universally driven element 64 is secured against axial movement from its seated position on the offsetting mandrel 14 by a circular retainer ring 70 that is received within an external retainer groove defined within the offsetting mandrel. If desired, the universally driven element 64 may have a splined connection with the offsetting mandrel 14 or it may be keyed to the offsetting mandrel so that a non-rotatable relation is established. Externally, the universally driven element 64 defines an external ring-like section 72 having a multiplicity of driven teeth in the form of gear teeth or splines. Internally, the tool collar 12 defines a corresponding multiplicity of internal drive teeth or splines 74 which establish rotary drive connection with the teeth or splines of the external ring-like section 72. The splines or gear toothed drive relationship between the tool collar 12 and the offsetting mandrel 14 is designed to permit pivotal movement of the offsetting mandrel 14 about the pivot point P while a direct rotary driving relationship is maintained between the offsetting mandrel 14 and the rotary tool collar 12.

As mentioned above, it is appropriate to permit significant angular positioning of the offsetting mandrel 14 about the pivot point P relative to the tool collar 12 and yet to maintain a sealed relationship between the offsetting mandrel and the tool collar which will contain the oil within the oil chamber 26 and protect the universal joint 16 and offsetting mechanism 18 from contamination by drilling fluid. According to the preferred embodiment of the present invention as shown in FIG. 2, a sealing assembly for the lower or forward end of the drilling tool is shown generally at 76 and incorporates a seal bellows 78 having an upper bellows support ring 80 which is seated in sealed relation about an outer seal surface 82 of the offsetting mandrel 14. The upper bellows support ring 80 is shouldered downwardly against a circular shoulder 84 of the offsetting mandrel 14. The opposite, or lower end, of the seal bellows 78 is secured to a bellows mounting and sealing ring 86 which is retained in sealed relation with a tubular seal mount 88 by a snap ring type retainer element 90 that is received within an internal groove within the tubular seal mount. The tubular seal mount 88 is secured by a thread connection 92 within the lower, or forward end, of the tool collar 12 and is further secured by the lower retainer flange 94 of a tubular end cap 96. The tubular end cap 96 is threadedly connected to the tool collar 12 by a thread connection 98. At its upper, or trailing end, the offsetting mandrel 14 is sealed with respect to the tubular tool collar 12 by an upper bellows seal 100. Although not required, the tubular end cap 96 may be provided with external spiral or fluted geometry that functions to assist the flow of drilling fluid upward through the annulus between the rotary steerable drilling tool and the wall of the wellbore being drilled.

As also mentioned above, the rotary steerable drilling tool of the present invention will be provided with an offsetting mechanism having the capability of maintaining the offsetting mandrel 14 in geostationary position relative to the formation being drilled and offset from the main wellbore above the location of the drilling tool. According to the preferred embodiment of the present invention, the rotary steerable drilling tool is provided with a hydraulically energized system for positioning the offsetting mandrel relative to the rotary tool collar and for maintaining geostationary position of the offsetting mandrel during rotation of the tool collar and during rotation of the offsetting mandrel by the rotary tool collar. To accomplish this feature, the rotary tool collar 12 defines two pairs of hydraulic cylinders with each pair of hydraulic cylinders being diametrically opposed from one another. As shown in FIG. 2, one pair of diametrically opposed hydraulic cylinders is indicated at 102 and 104. The diametrically opposed hydraulic cylinders are also shown in FIG. 4 as are diametrically opposed hydraulic cylinders 106 and 108. Hydraulic pistons 110, 112, 114, and 116 are movable within their respective hydraulic cylinders for the purpose of imparting positioning control to the offsetting mandrel 14 relative to the rotary tool collar 12. As shown in FIG. 2 and schematically in FIG. 4, an outer bearing race 118 is positioned for force transmitting contact with each of the four hydraulic pistons. As shown in FIG. 4, this outer bearing race 118 may define flat surfaces, such as shown at 120, to establish an efficient force transmitting surface engagement between the hydraulic pistons and the outer bearing race. An inner bearing race 122 is secured in non-rotatable relation with offsetting mandrel 14 by a splined connection 124 as shown in FIG. 2.

During drilling activity it is appropriate to continually adjust the position of the offsetting mandrel 14 about its pivot point P concurrently with rotary driving of the offsetting mandrel by the rotary tool collar 12 for the purpose of rotating the drill bit 20 and for maintaining the geostationary relation of the axis of the offsetting mandrel and the drill bit selectively pointed with respect to the formation being drilled. This feature permits a curved wellbore to be drilled which will have an inclination and bearing that is established by maintaining the axis of the offsetting mandrel geostationary as it is rotated by the tool collar 12. According to the present invention, as will be explained in detail below, geostationary axial positioning of the offsetting mandrel is established hydraulically under the control of servo-valves that are selectively actuated responsive to appropriate position sensing signals. As is evident from FIG. 3, hydraulic pressure induced energy for controlling the position of the offsetting mandrel 14 is generated by a hydraulic pump 126 which is located within a pump receptacle 128 defined within the rotary tool collar 12. The hydraulic pump 126 is driven by any suitable rotary drive mechanism with which the rotary steerable drilling tool 10 may be provided. As shown in FIG. 3, a positive displacement motor (PDM) or turbine 130 is rotatably driven by drilling fluid flowing from a tool flow passage 132 through the pump to thereby provide for driving rotation of a PDM or turbine output shaft 134. The PDM or turbine output shaft 134 is sealed with respect to an internal housing 136 about which a drilling fluid passage 138 is defined. If desired, the drilling fluid passage 138 may be defined by an annular space between an internal wall 140 of the tool collar 12 and the internal housing 136. This feature enables drilling fluid flow about the internal housing 136 to provide for cooling of the mechanical and electrical components that are located within the internal housing.

The output shaft 134 of the PDM or turbine 130 is sealed with respect to the rotatable tool collar 12 by a sealing element 142 to thereby prevent drilling fluid from contaminating the electrical and mechanical components that are located within the internal housing 136. The rotary shaft sealing element 142 is the only rotary seal component of the rotary steerable drilling system that is exposed to the drilling fluid. The output shaft 134 is connected in driving relation with an alternator 144 which provides an electrical output to power the electronic and electromechanical components of the drilling tool responsive to the flow of drilling fluid through the tool. The alternator is in turn provided with an output shaft 146 which is connected in driving relation with the hydraulic pump 126 so that the pump is driven responsive to the flow of drilling fluid through the actively controlled rotary steerable drilling tool. The hydraulic pump 126 may be a gear or piston pump as is suitable to the purposes of the user. The hydraulic pump 126 provides a pressurized hydraulic fluid output 148 which is conducted to servo-valves 150 and 152 which are also shown in the electronic/hydraulic schematic illustration of FIG. 4.

Responsive to the PDM or turbine 130, hydraulic pump 126 provides hydraulic fluid under pressure to hydraulic supply line 154 which supplies pressurized hydraulic fluid to a hydraulic pressure control 156 via hydraulic line 158 and conducts pressurized hydraulic fluid to the servo-valves 150 and 152 via hydraulic supply lines 160 and 162. In the valve condition shown in FIG. 4, pressurized hydraulic fluid supply to hydraulic cylinder 108 occurs via the servo-valve 152 and its hydraulic line 166, thus causing piston 116 to impart a force to the offsetting mandrel 14 along the X axis. Simultaneously, hydraulic fluid in hydraulic cylinder 106 is being returned via hydraulic line 170, servo-valve 152, and hydraulic return line 172 to the hydraulic reservoir 174. The servo-valve 150 is also positionable to supply pressurized hydraulic fluid via line 164 to the hydraulic cylinder 104 thereby causing movement of the piston 112 to impart a force through the bearing assembly to the offsetting mandrel 14 to thus shift the offsetting mandrel along the Y axis. Thus, positioning of the offsetting mandrel 14 is accomplished by operating the pistons 112 and 116 in 90 degree phase with one another. This character of valve positioning is accomplished by an electronic circuit 176 which may be described as a 90 degree phase circuit. The circuit 176 receives a signal via a signal conductor 178 from a controller 180 and then transmit signals via signal conductors 182 and 184 to the respective servo-valves 150 and 152. Thus, the servo-valves are operated simultaneously in such manner that they are shifted in a manner maintaining the 90 degree phase relationship of the force transmitting pistons.

Though the tool collar 12 is rotated during drilling operations and imparts direct driving rotation to the drill bit 20, this rotation may compromise or interfere with signals from the navigation sensors of the actively controlled rotary steerable drilling tool. To ensure against such rotational interference, the rotary tool collar 12 defines a reduced diameter intermediate section 186 as illustrated in FIG. 3. A coupling element in the form of a non-rotatable sliding sleeve 188 is located about the reduced diameter intermediate section and is supported in relatively rotatable relation therewith by bearing members 190 and 192. During drilling, the non-rotatable sliding sleeve is mechanically coupled with the wall "W" of the wellbore being drilled by a plurality of (preferably three) elastic blades such as shown at 194. The elastic blades 194 are of curved configuration and are located with the intermediate portions 196 thereof projecting radially outwardly from the sliding sleeve 188 for forcible contact with the wellbore wall "W". End portions 200 and 201 of each of the elastic blades 194 are connected to the non-rotatable sliding sleeve 188 in any suitable manner. Thus, as the rotary tool collar 12 is rotated during drilling the sliding sleeve 188 is maintained in substantially non-rotatable relation by the resistance of the elastic blades 194 with the wellbore wall "W" of the formation being drilled. Preferably the sliding sleeve 188 will have three elastic blades defining a three touch-point geometry for coupling with the borehole wall, though it may have a greater number of elastic blades without departing from the scope of the present invention. In actual operation, the non-rotatable sliding sleeve 188 may rotate slowly, perhaps only a few revolutions per hour. Electronic position signals from the navigation sensors, a resolver 202, which is mounted to the rotary tool collar 12, and a three-axis accelerometer 204 which is mounted to the slidng sleeve 188, will not require filtering or other electronic processing to minimize sensor signal interference. Since the accelerometers are located on the sliding sleeve 188 and are directly coupled with the borehole wall by the elastic blades 194, no high bandwidth sensor is required.

In addition to the three-axis accelerometer and resolver, the sliding, non-rotatable sleeve 188 will also employ a rotating transformer to transmit accelerometer measurements to the rotating section of the tool. A caliper measurement can also be integrated by measuring the radial displacement of each of the typically three elastic blades 194 relative to the non-rotatable sliding sleeve 188 of the drilling tool 10. If one end of each of the elastic blades is axially movable relative to the non-rotatable sliding sleeve 188, then the caliper measurement of the borehole may be achieved by measuring axial displacement of the elastic blades relative to the sleeve 188.

The controller 180 of the hydraulic servo-control loop system shown schematically in FIG. 4 receives electronic signal input from the resolver 202 and the three-axis accelerometer 204 via signal conductors 206 and 208. The controller 180 also receives signal input representing the radial positions of the hydraulic pistons 110 and 114 relative to the tool collar 12. The hydraulic cylinders 102 and 104 incorporate piston position measuring devices such as LVDT's 210 and 212 which measure radial displacement of the respective pistons 110 and 112 and transmit position signals via signal conductors 214 and 216 to the controller 180. These piston position signals are processed along with position signals from the resolver 202 and accelerometer 204 to yield the controller output signal that is fed via signal conductor 178 to the 90 degree phase circuit 176.

The present rotary steerable drilling system is based on hydraulic power controlled by servo-valves. No high power electronics are required. The present invention provides an effective solution to many problems that plague the steerable drilling systems of the prior art. The present invention does not require heat dissipation at high temperature when using PWM (pulse width modulation) power drives. The present invention achieves integration of formation evaluation measurements with low level signals, for example, resistivity, laterolog, and induction measurements. The control system of the present invention is low voltage, low power, and induces very low electromagnetic interferences. The present invention substantially eliminates the use of rotary seals that are in contact with the drilling fluid. The preferred embodiment set forth herein utilizes bellows seals to compensate for the oscillating motion of the offsetting mandrel relative to the rotary tool collar. The only rotary seal of the rotary steerable drilling system of the present invention is located in the power generation module, between the positive displacement motor (PDM) that is driven by the flowing drilling fluid and the alternator. According to the present invention it is not necessary to provide a source of hydraulic power from the surface. The hydraulic power system of the present invention is contained within the rotary steerable drilling tool and converts mechanical power from the flowing drilling fluid, directly via a PDM, to hydraulic power from the hydraulic pump. The hydraulic control loop of the rotary steerable drilling tool is automatically operable responsive to the signals of navigation sensors and control electronics for maintaining the offsetting mandrel oriented or pointed in a predetermined direction with its axis geostationary so that the drill bit supported thereby will drill a curved wellbore having a predetermined inclination and azimuth. The stabilization sensors used to detect the orientation of the offsetting mandrel are a resolver and at least one accelerometer. As the accelerometers are located on a non-rotating sliding sleeve that is directly coupled to the borehole by elastic coupling elements, no high bandwidth sensor is required. Bit offset is directly controlled by two servo-valves which are electrically controlled responsive to signals from navigation sensors which are processed by the electronics package on-board the rotary steerable drilling system. No additional steering system is required.

As mentioned above, certain steerable drilling systems have steering components that are in contact with the corrosive and erosive drilling fluid so that the service life thereof is compromised by the drilling fluid. The steering components of the rotary steerable drilling system of the present invention are protected from the drilling fluid. The hydraulic pistons are located internally of the drilling tool and are isolated from the drilling fluid. Virtually all of the movable mechanical components for positioning and rotary driving of the offsetting mandrel, such as the hydraulic pistons, servo-valves, and universal joint, are located within an internal chamber of the drilling tool which is filled with oil or other protective fluid medium so that these components are not exposed to drilling fluid. Thus, the service life of these components of the rotary steerable drilling system is not compromised by the drilling fluid.

In view of the foregoing it is evident that the present invention is one well adapted to attain all of the objects and features set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for drilling wells and simultaneously steering a drill bit with an actively controlled rotary steerable drilling system, said method comprising:

(a) rotating within the wellbore being drilled a tubular rotary tool collar and an offsetting mandrel mounted within said tubular rotary tool collar for movement relative thereto, said offsetting mandrel adapted for supporting a drill bit and being rotatably driven by said tubular rotary tool collar, said actively controlled rotary steerable drilling system having signal responsive steering means;

(b) generating steering signals for adjusting the position of said offsetting mandrel relative to said tubular rotary tool collar and said offsetting mandrel; and (c) responsive to said steering signals maintaining said offsetting mandrel oriented at predetermined angles of inclination and bearing during rotation thereof by said tubular rotary tool collar.

2. The method of claim 1, wherein a coupling element is mounted for relative rotation with said tubular rotary tool collar and has a plurality of elastic coupling blades projecting radially outwardly therefrom for contact with the wall of the wellbore being drilled, said method further comprising:

(d) maintaining said plurality of elastic coupling blades in mechanically coupled substantially static relation with the formation being drilled during rotation of said tubular rotary tool collar.

3. The method of claim 1, wherein a coupling element is disposed in rotatable relation with said tubular rotary tool collar and navigation sensors are mounted to said coupling element, said method further comprising:

(d) maintaining said coupling element and said navigation sensors in substantially static relation with the wellbore being drilled during rotation of said tubular rotary tool collar.

4. The method of claim 1, wherein said actively controlled rotary steerable drilling system has hydraulic and electrical systems for generating hydraulic fluid pressure and for generating electrical energy responsive to flowing drilling fluid, and hydraulic piston means for imparting position controlling movement to said offsetting mandrel relative to said tubular rotary tool collar, and at least one servo-valve for controlling hydraulic pressure induced movement of said hydraulic piston means responsive to said steering signals, said method further comprising:

(d) generating hydraulic pressure and electrical energy responsive to drilling fluid flow; and (e) electrically actuating said at least one servo-valve responsive to said steering signals for controlling transmission of hydraulic pressure to said hydraulic piston means and hydraulically moving said offsetting mandrel relative to said tubular rotary tool collar.

5. The method of claim 4, wherein said hydraulic piston means includes at least two pistons each located within said tubular rotary tool collar and interposed between and in force transmitting relation with said tubular rotary tool collar and said offsetting mandrel, said method further comprising:

(f) selectively and independently controlling application of hydraulic pressure to each of said hydraulic pistons for causing piston actuated pivotal positioning of said offsetting mandrel within said tubular rotary tool collar during rotation of said tubular rotary tool collar.

6. The method of claim 1, wherein said tubular rotary tool collar has hydraulic cylinder means with hydraulic piston means movably located within said hydraulic cylinder means and disposed in force transmitting relation with said offsetting mandrel, and servo-valves for controlling hydraulic pressure to said hydraulic cylinder means, said method further comprising:

(d) detecting the respective positions of said hydraulic piston means within said hydraulic cylinder means and generating electronic piston position signals;

(e) identifying desired position change of said hydraulic piston means within said hydraulic cylinder means for desired position change of said offsetting mandrel relative to said tubular rotary tool collar; and (f) controllably actuating said servo-valves for independently controlling hydraulic pressure communication to said hydraulic cylinder means for accomplishing said desired position change of said hydraulic piston means.

7. The method of claim 6, wherein said hydraulic cylinder means has hydraulic fluid therein for imparting hydraulic piston movement responsive to hydraulic pressure, said method further comprising:

(g) detecting the volume of hydraulic fluid within said hydraulic cylinder means for identification of piston position within said hydraulic cylinder means;

(h) changing the volume of hydraulic fluid within said hydraulic cylinder means to thus change said hydraulic piston position and thus change the position of said offsetting mandrel within said tubular rotary tool collar; and (i) sequentially changing the position of said offsetting mandrel within said tubular rotary tool collar to maintain said offsetting mandrel in substantially geostationary relation and oriented with respect to predetermined azimuth and inclination during rotation thereof by said tubular rotary tool collar.

8. The method of claim 1, wherein said generating steering signals comprises:

(a) sensing the location and orientation of said tubular rotary tool collar and the angular position of said offsetting mandrel relative to said tubular rotary tool collar and generating real time position signals;

(b) processing said real time position signals and generating said steering signals therefrom; and (c) controlling application of hydraulically induced force to said offsetting mandrel responsive to said steering signals to maintain said offsetting mandrel selectively positioned relative to said tubular rotary tool collar.

9. The method of claim 1, wherein said rotary steerable drilling system includes on-board electronics for receiving telemetry transmitted steering control signals, said method further comprising:

(d) transmitting steering control signals via signal telemetry from a surface location to said on-board electronics of said rotary steerable drilling system; and (e) controlling geostationary positioning of said offsetting mandrel relative to said tubular rotary tool collar with said steering signals.

10. The method of claim 1, wherein said tubular rotary tool collar has at least two hydraulic cylinders therein each having a hydraulic piston disposed in positioning force transmitting relation with said offsetting mandrel, a pressurized hydraulic fluid supply to said hydraulic cylinders and hydraulic servo-valve means for selectively communicating pressurized hydraulic fluid from said hydraulic fluid supply to said hydraulic cylinders, and a controller for receiving position signals and selectively actuating said hydraulic servo-valve means for hydraulically controlled positioning of said offsetting mandrel relative to said rotary tool collar, said method further comprising:

(d) generating piston position signals representing the positions of said hydraulic pistons within said hydraulic cylinders;

(e) providing tool collar position signals representing the position of said tubular rotary tool collar; and (f) processing said piston position signals and said tool collar position signals by said controller and providing valve position output signals from said controller for changing the position of said hydraulic servo-valves as necessary to maintain a predetermined angular position of said offsetting mandrel relative to said tubular rotary tool collar.

11. A method for drilling wells and simultaneously steering a drill bit with an actively controlled rotary steerable drilling system, said method comprising:

(a) rotating within the wellbore being drilled a tubular rotary tool collar and an offsetting mandrel mounted within said tubular rotary tool collar for movement relative thereto, said offsetting mandrel adapted for supporting a drill bit and being rotatably driven by said tubular rotary tool collar;

(b) controlling the movement of said offsetting mandrel within said rotary tool collar by means of a plurality of pistons mounted between said mandrel and said tool collar;

(c) generating steering signals representing positional aspects of said tubular rotary tool collar and said offsetting mandrel; and (d) responsive to said steering signals, maintaining said offsetting mandrel substantially geostationarily positioned and oriented at predetermined angles of inclination and bearing during driving rotation thereof by said tubular rotary tool collar.

12. An actively controlled rotary steerable well drilling apparatus, comprising:

(a) a tubular rotary tool collar adapted to be rotatably driven for well drilling;

(b) an offsetting mandrel mounted within said tubular rotary tool collar for positioning movement relative to said tubular rotary tool collar, said offsetting mandrel being rotated by said tubular rotary tool collar and supporting a drill bit;

(c) actuator means maintaining said offsetting mandrel selectively oriented relative to said tubular rotary tool collar to thus maintain said offsetting mandrel and drill bit pointed in a selected direction for drilling along an intended course; and (d) means selectively controlling said actuator means.

13. The actively controlled rotary steerable well drilling apparatus of claim 12, further comprising:

(e) a coupling element rotatably mounted to said tubular rotary tool collar and having substantially static coupling contact with the wall of the wellbore being drilled; and (f) navigation sensors mounted to said coupling element and generating navigation signals.

14. The actively controlled rotary steerable well drilling apparatus of claim 13, further comprising:

(g) resilient coupling means projecting from said coupling element and maintaining said substantially static coupling contact with the wall of the wellbore being drilled.

15. The actively controlled rotary steerable well drilling apparatus of claim 14, wherein said resilient coupling means includes a plurality of resilient coupling members located in evenly spaced relation about said coupling element; and further comprising:

(h) means for detecting the relative positions of said resilient coupling members within said coupling element and generating therefrom signals representing caliper measurement of the wellbore being drilled.

16. The actively controlled rotary steerable well drilling apparatus of claim 13, wherein said actuator means are hydraulic actuator means; and further comprising:

(g) hydraulic fluid supply means located within said tubular rotary tool collar;

(h) electrical power supply means located within said tubular rotary tool collar;

(i) servo-valve means within said hydraulic fluid supply means for controlling the supply of pressurized hydraulic fluid to said hydraulic actuator means;

(j) position sensing means for sensing the position of said hydraulic actuator means and providing a position signal output; and (k) controller means for receiving and processing said navigation signals and said position signal output and providing positioning control signals for selectively controlling actuation of said servo-valve means.

17. The actively controlled rotary steerable well drilling apparatus of claim 13, further comprising:

(g) telemetry means within said coupling element for receiving positioning control signals transmitted from the surface and providing a telemetry signal output;

(h) controller means for receiving and processing said telemetry signal output and providing said positioning control signals; and wherein said actuator means have positioning control of said offsetting mandrel responsive to said positioning control signals.

18. The actively controlled rotary steerable well drilling apparatus of claim 13, further comprising:

(g) at least one accelerometer supported by said coupling element for detecting rotation of said tubular rotary tool collar relative to said coupling element and providing position signals responsive thereto;

(h) at least one resolver supported by said tubular rotary tool collar for detecting rotation of said tubular rotary tool collar relative to said coupling element and providing position signals responsive thereto; and (i) controller means for receiving and processing said position signals and providing positioning control signals; and wherein said actuator means positions said offsetting mandrel relative to said tubular rotary tool collar responsive to said positioning control signals.

19. The actively controlled rotary steerable well drilling apparatus of claim 12, wherein said actuator means comprises:

(a) hydraulic cylinder means within said tubular rotary tool collar;

(b) hydraulic piston means within said hydraulic cylinder means and having force transmitting relation with said offsetting mandrel;

(c) hydraulic supply means for supplying pressurized hydraulic fluid to said hydraulic cylinder means for maintaining substantially geostationary positioning of said offsetting mandrel within said tubular rotary tool collar; and (d) servo-valve means for controllably actuating said hydraulic supply means and maintaining said offsetting mandrel selectively oriented relative to said tubular rotary tool collar during rotation of said tubular rotary tool collar.

20. The actively controlled rotary steerable well drilling apparatus of claim 12, further comprising:

(e) a universal joint within said tubular rotary tool collar; and wherein said offsetting mandrel is pivotally supported by said universal joint and is pivotally movable relative to said tubular rotary tool collar for positioning of said offsetting mandrel relative to the formation being drilled.

21. The actively controlled rotary steerable well drilling apparatus of claim 20, wherein:

said universal joint establishes direct rotary driving relation of said tubular rotary tool collar with said offsetting mandrel.

22. The actively controlled rotary steerable well drilling apparatus of claim 12, wherein said offsetting mandrel defines a flow passage for flow of drilling fluid therethrough; and further comprising:

(e) collar seal means establishing sealing between said tubular rotary tool collar and said offsetting mandrel and defining a protective fluid chamber for containing a protective fluid medium, said collar seal means isolating said protective fluid chamber from intrusion by drilling fluid.

23. The actively controlled rotary steerable well drilling apparatus of claim 12, further comprising:

(e) a hydraulic fluid supply system located within said tubular rotary tool collar and powered by the flow of drilling fluid during drilling, said hydraulic fluid supply system supplying pressurized hydraulic fluid to said actuator means;

(f) an electrical power supply system located within said tubular rotary tool collar and powered by the flow of drilling fluid during drilling; and (g) servo-valve means within said hydraulic fluid supply system for controlling the supply of pressurized hydraulic fluid to said actuator means.

24. The actively controlled rotary steerable well drilling apparatus of claim 23, further comprising:

(h) a coupling element mounted in rotatable relation with said tubular rotary tool collar;

(i) navigation sensors mounted to said coupling element and providing navigation signals; and (j) controller means located within said coupling element for receiving said navigation signals, said controller means providing valve control output signals for selectively controlling operation of said servo-valve means.

25. The actively controlled rotary steerable well drilling apparatus of claim 12, wherein said actuator means comprises at least two hydraulically movable piston elements each having force transmitting relation with said offsetting mandrel; and wherein upon actuation thereof said hydraulically movable piston elements move said offsetting mandrel relative to said tubular rotary tool collar to maintain selective positioning thereof relative to said tubular rotary tool collar thereby maintaining selected positioning of said offsetting mandrel with respect to the formation being drilled.

* * * * *